United States Patent [19]

Billimoria et al.

[11] Patent Number: 4,597,775

[45] Date of Patent: Jul. 1, 1986

[54] COKING AND GASIFICATION PROCESS

[75] Inventors: Rustom M. Billimoria, Houston; Frank F. Tao, Baytown, both of Tex.

[73] Assignee: Exxon Research and Engineering Co., Florham Park, N.J.

[21] Appl. No.: 602,309

[22] Filed: Apr. 20, 1984

[51] Int. Cl.[4] ..... C10J 3/54

[52] U.S. Cl. ..... 48/197 R; 48/210; 201/20; 201/31; 201/36; 208/409; 208/420; 208/428; 208/951

[58] Field of Search ..... 201/9, 31, 36, 28, 29, 201/20; 48/210, 202, 197 R; 208/8 R

[56] References Cited

U.S. PATENT DOCUMENTS

| | | | |
|---|---|---|---|
| 2,221,410 | 11/1940 | Pier | 260/668 |
| 2,582,711 | 1/1952 | Nelson | 201/31 |
| 2,582,712 | 1/1952 | Howard | 201/28 |
| 3,451,896 | 6/1969 | Schon | 201/29 |
| 3,966,633 | 6/1976 | Friedman | 48/202 |
| 4,057,484 | 11/1977 | Malek | 208/8 |
| 4,060,478 | 11/1977 | Lang | 201/20 |
| 4,085,029 | 4/1978 | Malek | 208/8 |
| 4,259,168 | 3/1981 | Liotta | 201/20 |
| 4,259,172 | 3/1981 | Liotta | 208/46 |

FOREIGN PATENT DOCUMENTS

| | | | |
|---|---|---|---|
| 2530600 | 1/1977 | Fed. Rep. of Germany | 48/202 |

OTHER PUBLICATIONS

Peter et al., Catalytic Gasification of Coal with High-Pressure Steam, International Chem. Engr. vol. 18, No. 2, 4/1978.

*Primary Examiner*—Peter Kratz

*Attorney, Agent, or Firm*—Wayne Hoover

[57] ABSTRACT

An improved coking process for normally solid carbonaceous materials wherein the yield of liquid product from the coker is increased by adding ammonia or an ammonia precursor to the coker. The invention is particularly useful in a process wherein coal liquefaction bottoms are coked to produce both a liquid and a gaseous product. Broadly, ammonia or an ammonia precursor is added to the coker ranging from about 1 to about 60 weight percent based on normally solid carbonaceous material and is preferably added in an amount from about 2 to about 15 weight percent.

8 Claims, 1 Drawing Figure

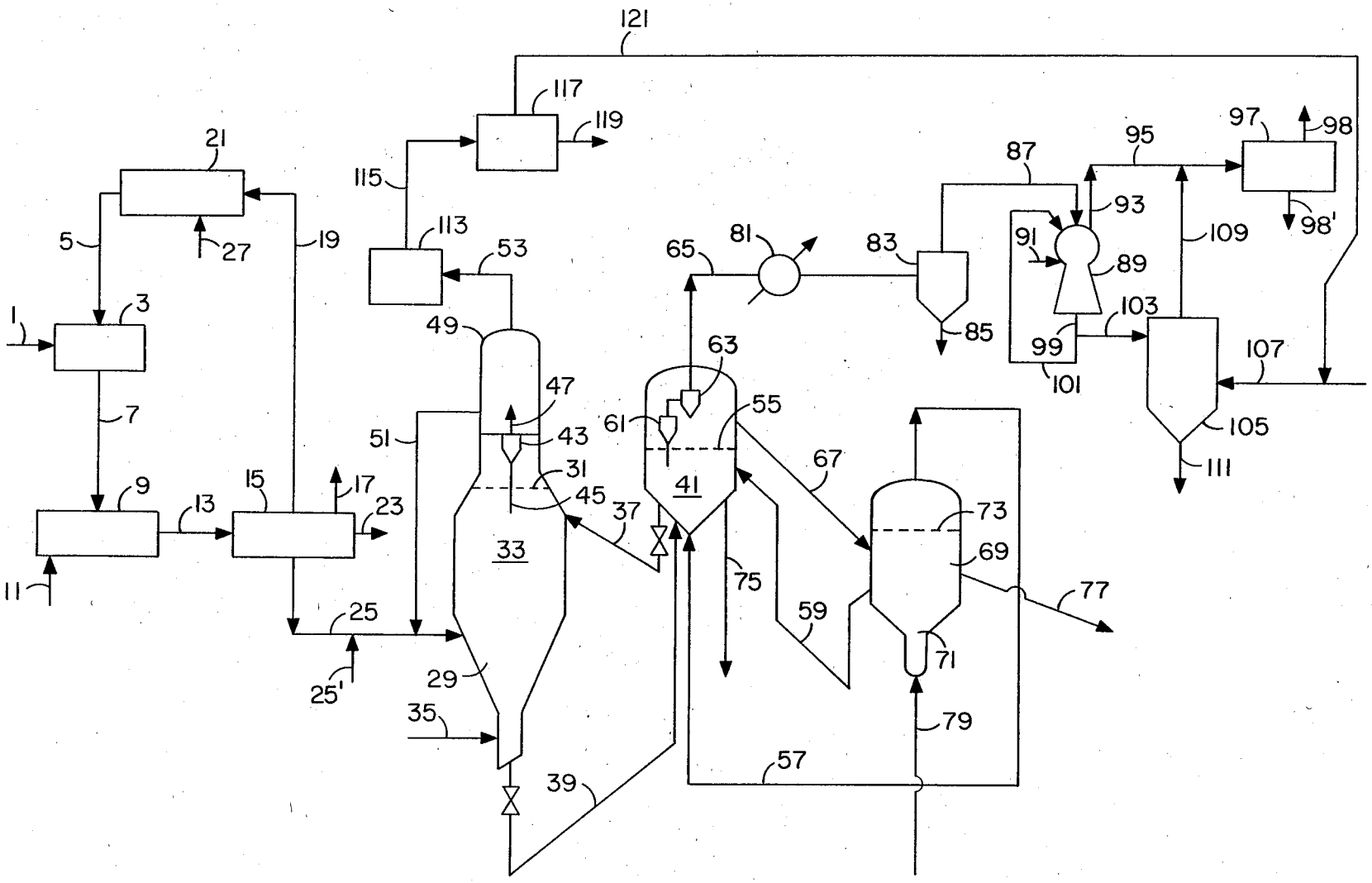
1
3
5
7
9
11
13
15
17
19
21
23
25
25'
27
29
31
33
35
37
39
41
43
45
47
49
51
53
55
57
59
61
63
65
67
69
71
73
75
77
79
81
83
85
87
89
91
93
95
97
98
98'
99
101
103
105
107
109
111
113
115
117
119
121

COKING AND GASIFICATION PROCESS

The Government of the United States of America has rights in this invention pursuant to Contract No. DE-FC05-77ET10069 (formerly Contract No. EF-77A-01-2893) awarded by the U.S. Energy Research and Development Administration, now the U.S. Department of Energy.

BACKGROUND OF THE INVENTION

This invention relates to an improved coking process. More particularly, this invention relates to an improved coking process wherein coal and coal residues are converted.

It is known to produce liquids, fuel gases and coke via integrated coking and gasification processes such as those disclosed in U.S. Pat. Nos. 3,661,543; 3,702,516 and 3,759,676. It is also known to produce such liquids, gases and coke from coal feeds and particularly coal liquefaction bottoms in processes such as those disclosed in U.S. Pat. Nos. 3,617,513; 4,060,478 and 4,075,079.

In general, and when coal and coal liquefaction bottoms are fed to such a coker, the yield of liquids and particularly liquids boiling below about 1000° F. (538° C.) is lower than might be desired in light of the higher relative value of liquid products when compared to the value of the coke in the gaseous products thus produced. This is particularly true in that case where the coker is an integral part of a coal liquefaction process and liquid is the desired product. Moreover, the quality of such liquid products has been less than satisfactory when the coker is operated in a conventional manner and as proposed in the aforementioned U.S. patents. The need, then, for an improved coking process wherein the yield of liquid product boiling below about 1000° F. (538° C.) and the quality thereof is improved is believed to be readily apparent.

SUMMARY OF THE INVENTION

It has now been discovered that the foregoing and other disadvantages of the prior art coking processes can be reduced with the method of the present invention and an improved process for coking coal liquefaction bottoms or a similar normally solid carbonaceous material which is molten at the coking conditions provided thereby. It is, therefore, an object of this invention to provide an improved process for coking coal liquefaction bottoms or a similar normally solid carbonaceous material which is molten at the coking conditions. It is still another object of this invention to provide such an improved process wherein the yield of liquid products boiling below about 1000° F. (538° C.) is increased. It is a still further object of this invention to provide such an improved process wherein the quality of such liquid products is improved. The foregoing and other objects and advantages will become apparent from the description set forth hereinafter and from the drawings appended thereto.

In accordance with the present invention, the foregoing and other objects and advantages are accomplished by effecting the coking of the coal liquefaction bottoms or a similar normally solid carbonaceous material which is molten at coking conditions in the presence of gaseous ammonia and/or the decomposition or reaction products of gaseous ammonia at the conditions of the coking operation. As is indicated more fully hereinafter, the gaseous ammonia may be added directly to the coker or as a compound which will yield gaseous ammonia in the coker at the coking conditions.

BRIEF DESCRIPTION OF THE DRAWINGS

The FIGURE is a schematic flow diagram of a process within the scope of the present invention.

DETAILED DESCRIPTION OF THE INVENTION

As indicated, supra, the present invention relates to an improved coking process wherein coal liquefaction bottoms or a similar normally solid carbonaceous material which is molten at the coking conditions is coked in the presence of gaseous ammonia and/or a decomposition or reaction product thereof to produce an increased yield of liquid products boiling at temperatures below about 1000° F. (538° C.), which liquid products are of improved quality when compared to the liquid products produced during coking in the absence of gaseous ammonia. In general, the improved process of this invention may be used to coke any normally solid carbonaceous material which is molten at the conditions used during the coking. The process is particularly useful in the coking of carbonaceous residues (liquefaction bottoms) remaining after the liquefaction of anthracite, bituminous coal, subbituminous coal, lignite, peat, brown coal and the like.

The normally solid carbonaceous material may be fed to the coker as a solid. When this is done, the normally solid carbonaceous material will be ground to a finely divided state. The particular particle size, or particle size range actually employed, however, is not critical to the invention so long as the particles are capable of fluidization. The normally solid carbonaceous material may also be processed in a molten state. When this is done, the molten, normally solid carbonaceous material fed to the coker will be atomized to the extent required to effect coking in a fluidized state.

In the improved process of the present invention, the feed is introduced into a coking vessel wherein the coking is accomplished in a fluidized bed of solids (e.g., coke particles of 40–1000 microns in size). A fluidizing gas is introduced at or near the bottom of the coker in an amount sufficient to obtain superficial fluidizing gas velocities in the range of from about 0.5 to about 5 feet per second. Generally, the coking is accomplished at a temperature within the range from about 850° to about 1400° F. (from about 454° to about 760° C.) and at a pressure within the range from about 5 to about 150 psig (from about 0.3 to about 1 mP).

The gaseous ammonia may be added directly to the coker with or as a part of the fluidization gas or a compound which will yield gaseous ammonia to conditions used in the coker may be added with a normally solid carbonaceous material fed to the coker or with the fluidization gas. Obviously, the manner through which gaseous ammonia is added to the coker is not critical to the present invention. Compounds which will yield gaseous ammonia to coking conditions include, but are not limited to, liquid ammonia, ammonium salts such as ammonium acetate, ammonium calcium phosphate, ammonium carbonate, ammonium chloride, ammonium chromate and the like. Other compounds that would yield gaseous ammonia at the temperature and pressure of the coking will be readily apparent to those of ordinary skill in the chemical arts.

In general, sufficient gaseous ammonia or an ammonia precursor will be added to the coker to provide from about 1 to about 60 weight percent $NH_3$ based on solid carbonaceous feed to said coker. As indicated previously, suitable ammonium precursors include, but are not limited to, liquid ammonia, ammonium hydroxide, ammonium salts, quarternary ammonium salts and the like.

While the inventors do not wish to be bound by any particular theory, it is believed that the ammonia serves as a stabilizer or free radical terminator and as a hydrogen donor during the coking operation. It is also believed that the ammonia causes amine formations which prevent the formation of large aromatic structures in the coker liquids and reduces the amount of polynucleararomatic compounds and coke produced. This, in turn, leads to an increase in total liquid yield during coking and an improved liquid product quality. Hydrotreating of a liquid product will remove the amine compounds and regenerate the ammonia for reuse or recycle.

Heretofore and particularly in coking operations which have been used to produce additional liquid product and a low btu gas from coal liquefaction bottoms, the liquid products are usually heavy in nature requiring considerable upgrading before they can be used as an end product such as a fuel or blended with petroleumderived products. The liquid product derived from the present invention, however, is usually lighter in nature and, at least, requires less upgrading before the same may be used as an end product such as a fuel or blended with a petroleum-derived end product.

The heat required to effect the coking can, in general, be provided via any of the techniques known in the prior art. For example, a portion of the feed material or a portion of the coke product can be burned in a separate combustor and the combustion effluent gases passed into the coker. When this is done, the combustion effluent gases would be used at least partially to effect fluidization of the coke bed. Ideally, however, heat will be provided by circulating a portion of the coke contained in the fluid bed through a separate heater or combustor and then back into the coker. This technique offers the advantage of an increased quality gas product withdrawn overhead from the coker.

During the coking operation, at least a portion of the carbonaceous material will be converted to a normally liquid product and another portion will be converted to a normally gaseous product. The remainder will be converted to coke. The liquid product, which is generally of an improved quality and obtained in an increased yield, is generally withdrawn from the lower portion of the coker while the gaseous product is withdrawn overhead. Normally the overhead gaseous product can be scrubbed and fractionated to produce a relatively high btu gas. Similarly, the liquid product may be fractionated and upgraded to produce a broad range of liquid fuels. The upgrading required, however, will be significantly less than that required in the upgrading of prior art coker liquid products.

Normally, the coke product will contain a relatively high concentration of inorganic material matter such as quartz, alumina and pyrrhotite and will not be particularly useful as a coke. As a result, it is advantageous to gasify the coke in a separate vessel to produce a low or intermediate btu gas which can be more conveniently burned as a fuel, upgraded to produce a relatively high purity hydrogen strain or a synthesis gas stream which can then be used in chemical synthesis. The coke may be withdrawn directly from the coking vessel and passed to the gasifier or the coke may be withdrawn from the coker, passed through a heater and then into the gasifier. In either case, the gasification will be accomplished in a fluid bed at a temperature within the range from about 1600° F. to about 2000° F. (from about 871° to about 1089° C.) and at a pressure within the range from about 15 to about 100 psig (from about 0.1 to about 0.67 mP). A fluidization gas is introduced at or near the bottom of the gasifier. In general, a gasification reagent will be contacted with the coke in the gasifier and this reagent may be included in the fluidization gas. Steam, carbon dioxide and mixtures of these are particularly effective gasification reagents.

In the gasifier, a gaseous product comprising hydrogen, carbon monoxide, carbon dioxide and steam is produced. This product may be scrubbed and/or separated to produce a relatively high purity hydrogen or a mixture of hydrogen and CO. The solid residue which will comprise primarily the mineral matter and some unconverted carbon will be withdrawn from the gasifier. The solid residue may be discarded directly or further processed to obtain one or more of the constituents thereof as a byproduct.

PREFERRED EMBODIMENT

In a preferred embodiment of the present invention, the improved integrated coking and gasification process will be used to convert bottoms from a solid carbonaceous material liquefaction process and particularly bottoms from a process wherein bituminous coal, subbituminous coal, lignite, peat, brown coal or the like has been liquefied. In general, the bottoms from any such process may be upgraded in the integrated coking and gasification process of this invention. In a most preferred embodiment, however, the bottoms from such a process wherein the liquefaction is accomplished at an elevated temperature and pressure and in the presence of a hydrogen donor solvent will be converted. Such a process is illustrated in FIG. 1.

Referring then to FIG. 1, coal in a particulate form of a size ranging up to about ¼ inch particle size diameter, suitably 8 mesh (Tyler) is introduced via line 1 into mixing zone 3 wherein it is slurried with a hydrogen donor solvent introduced through line 5. Preferably, the solvent and coal are admixed in a solvent:coal ratio ranging from 0.8:1 to about 10:1, most preferably from about 1:1 to about 3:1.

The hydrogen donor solvent employed will normally be an intermediate stream having an initial boiling point within the range from about 350° F. to about 425° F. and a final boiling point within the range from about 700° F. to about 800° F. Preferably, the solvent will be a distillate fraction separated from the coal liquefaction product. Generally, the solvent will comprise aromatics, partially hydrogenated aromatics and naphthenic hydrocarbons. As is well known in the prior art, the partially hydrogenated aromatics are capable of donating hydrogen at coal liquefaction conditions and the solvent will, generally, contain from about 30 to about 55 weight percent of such compounds.

The coal slurry is withdrawn from mixing zone 3 through line 7 and passed the coal liquefaction zone 9. Within the coal liquefaction zone 9, the liquefaction conditions include a temperature within a range from about 700° F. to about 950° F., most preferably from about 800° F. to about 880° F. and pressures within the range from about 300 psia to about 3000 psia, most preferably from about 1500 psia to about 2500 psia. Generally, molecular hydrogen is present during liquefaction and in the embodiment illustrated, molecular hydrogen is introduced into the liquefaction zone through line 11. Generally, molecular hydrogen is added at a rate within the range from about 500 to about 10,000 scf/bbl of liquid product, preferably from about 1000 to about 6000 scf/bbl. Generally, contacting of the slurry and molecular hydrogen will be continued at liquefaction conditions for a period within the range from about 20 minutes to about 150 minutes, most preferably from about 40 minutes to about 90 minutes.

The product from the coal liquefaction zone comprises a mixture of normally gaseous components, normally liquid components, including depleted hydrogen donor solvent, unconverted coal and mineral matter. In the embodiment illustrated, the entire product is withdrawn from the liquefaction zone through line 13 and transferred to separation zone 15. In the separation zone, the liquefaction product is divided into a gaseous fraction recovered overhead through line 17, an intermediate fraction suitable for use as a solvent withdrawn through line 19, a heavier fraction withdrawn through line 23 and a bottoms fraction withdrawn through line 25. The gaseous fraction may, and generally will, be scrubbed and fractionated to produce a normally gaseous product comprising C1 and C2 hydrocarbons and a normally liquid product boiling in the light naphtha range. In the embodiment illustrated, at least a portion of the intermediate fraction is passed to catalytic solvent hydrogenation zone 21. The heavier fraction may be withdrawn as product or upgraded via conventional techniques to a lighter fuel. Generally, the heavier fraction will have an initial boiling point within the range from about 700° to about 800° F. and a final boiling point within the range from about 950° to about 1100° F. The bottoms fraction, which will have an initial boiling point within the range from about 950° to about 1100° F., will have a carbon content within the range from about 15 to about 40 weight percent and will contain the inorganic mineral matter initially present in the coal feed. That portion of the intermediate fraction (solvent fraction) introduced into the catalytic hydrogenation zone is contacted with molecular hydrogen introduced through line 27 in the presence of a catalyst. Generally, the conditions in the catalytic solvent hydrogenation zone will include a temperature within the range from about 650° to about 850° F., preferably from about 700° to about 800° F., and a pressure within the range from about 650 psia to about 2000 psia, preferably from about 1000 psia to about 1500 psia. The hydrogen treat rate will range from about 1000 to about 10,000 scf/bbl, preferably from about 2000 to about 5000 scf/bbl. The hydrogenation catalysts employed are conventional. Typically, such catalysts comprise an alumina or silica alumina support, composited with one or more Group VIII non-noble metals and one or more Group VI metals of the Periodic Table of Elements. Typical catalysts include oxides and/or sulfides of cobalt-molybdenum, nickel-molybdenum, nickel-tungsten, nickel-molybdenum-tungsten, cobalt-nickel-molybdenum and the like.

In accordance with the improved process of this invention, the bottoms fraction withdrawn through line 25 is fed to a coking zone 29 which comprises a fluid bed of solid coke or coke plus inorganic mineral matter. Prior to feeding the bottoms fraction to the coker, the bottoms may be combined with liquid or gaseous ammonia or a suitable gaseous ammonia precursor added through line 25' or added with the fluidization gas through line 35. Generally, the fluid bed level in the coker will be reflected with an upper level indicator at 31. The solids are maintained in the fluidized state by introducing a suitable fluidizing gas at the base of coking reactor 33 through line 35 in an amount sufficient to obtain superficial fluidizing gas velocities within the range from about 0.5 to about 5 feet/second. In general, any inert gas could be used to effect fluidization but steam is particularly preferred. As also indicated, supra, the fluidizing gas may include gaseous ammonia or a gaseous ammonia precursor.

In a preferred embodiment, sufficient ammonia or an ammonia precursor will be added to provide from about 2.0 to about 15 weight percent ammonia based on coke in the solid carbonaceous feedstock. In a most preferred embodiment, liquid ammonia will be combined with the bottoms in line 25 through line 25'.

In a preferred embodiment, the coking is accomplished at a temperature within the range from about 900° to about 1200° F. and at a pressure within the range from about 5 to about 45 psig. In the embodiment illustrated, the coking temperature is maintained by withdrawing a stream of coke from the coker through line 39, passing this stream through heater 41 and then passing at least a portion of this stream back to the coker through line 37. Generally, the temperature of the coke from the burner will be from about 100° to about 800° F. above the actual operating temperature of the coking zone.

Conversion products from the coker pass through cyclone 43 to remove entrained solids which are returned to the coking zone through dip leg 45. The gaseous product is then withdrawn through line 47 and intra scrubber. In the embodiment illustrated, the scrubber is mounted on the coking reactor. If desired, a stream of heavy material condensed in the scrubber may be recycled to the coking reactor via line 51. The coker conversion products are withdrawn from the scrubber through line 53 and fractionated in a conventional manner in fractionation zone 113. A normally gaseous fraction comprising light hydrocarbon gases, hydrogen and nitrogen is removed from fractionation zone 113 and in the embodiment illustrated is passed through cryogenic fractionator 117 through line 115. A liquid fraction comprising hydrocarbons is removed through line 119. A gas substantially free of hydrocarbons heavier than methane and comprising hydrogen, nitrogen and methane, is removed from the cryogenic fractionator through line 121 and in the embodiment illustrated is passed to stripping zone 105 through line 107 to provide at least a portion of the stripping gas required therein. Typically, this gas comprises about 30 to about 50 mole percent hydrogen and about 50 to about 70 mole percent $C_1$–$C_4$ hydrocarbon gas. Each of the constitutents may be separated using conventional technology.

In heater 41, stripped coke from coking reactor 33 (commonly referred to as cold coke) is introduced through line 39 to a fluid bed of hot coke generally having an upper level indicated at 55. The bed is partially heated by passing a fuel gas into a heater through line 57. Supplementary 25 heat is supplied to the heater by coke circulating in line 59. The gaseous effluent of the heater including entrained solids passes through a cyclone which may be a first cyclone 61 and a second cyclone 63 wherein separation of the larger entrained solids occurs. The separated larger solids are returned to the heater bed via the 30 respective cyclone dip legs. The heated gaseous effluent, which still contains entrained solid fines, is removed from heater 41 via line 65. The fines removal system will be subsequently described herein.

Hot coke is removed from the fluidized bed in heater 41 and recycled to coking reactor 33 through line 37 to supply heat thereto. Another portion of coke is removed from heater 41 and passed through line 67 to a gasification zone 69 in gasifier 71 which comprises a fluidized bed of coke having a level indicated at 73. As previously indicated, however, the coke in the gasifier fluidized bed will contain significant concentrations or inorganic mineral matter and as gasification continues, the amount of carbon in the fluidized bed of particles will, generally, be within the range from about 35 to about 50 weight percent. Excess coke may be withdrawn from the heater through line 75 and this coke, which contains significant concentrations of the inorganic mineral matter, may be burned or gasified or discarded directly.

The gasifier zone is maintained at a temperature within the range from about 1500° to about 1800° F. and at a pressure within the range from about 5 to about 150 psi, preferably at a pressure within the range from about 10 to about 60 psig and most preferably at a pressure within the range from about 25 to about 45 psig. Sufficient gas to maintain a fluid bed is introduced into the gasifier through line 79. The fluidization gas will contain at least one component capable of reacting with the coke in the fluid bed such as steam, carbon dioxide or mixtures of such components. In a preferred embodiment, steam will be used and a gaseous product comprising primarily hydrogen and carbon monoxide will be produced. The product gas from the gasifier, which may contain entrained solids, is withdrawn overhead through line 57 and introduced into heater 41 to provide a portion of the required heat as previously described. Also, and as previously indicated, a portion of the hot coke in the gasifier may be circulated to heater 41 through line 59.

While the fluid coking and gasification process has been described for simplicity of description with respect to circulating coke as a fluidized medium, it is to be understood that the fluidized seed particles on which the coke is deposited in the coker may be silica, alumina, zirconia, magnesia, calcium oxide, Alundum, mullite, bauxite or the like. Moreover, and as stressed throughout, the coke will contain significant quantities of inorganic mineral matter originally contained in the feed and, therefore, would not be, generally, useful as coke.

In the embodiment illustrated, the heater gaseous effluent containing entrained solids is withdrawn through line 65 and may be passed through an indirect heat exchanger 81 and then into cyclone 83 wherein a portion of the entrained solids are separated and removed from the cyclone as dry fines through line 85. A gaseous hydrogen and carbon monoxide-containing gas stream, including any remaining entrained solids, is removed from cyclone 83 through line 87 and passed through a scrubber 89. In the embodiment illustrated, scrubber liquid is introduced through line 91. The scrubbed fuel gas is recovered through line 93 and passed to gas clean-up process 97, through line 95. The fuel gas is recovered from the gas clean-up process through line 98. Impurities may be withdrawn through line 98'.

The scrubbing liquid may be water, a water solution containing a chemical reactant or absorbing agent, or a hydrocarbon oil such as, for example, a gas oil. When water is used as the scrubbing liquid in the scrubber, at least a portion of the solids present in the gaseous stream is separated from the gas to form, with the scrubbing water, a dilute solids-water slurry which is removed from the scrubber by line 99. The dilute slurry also comprises acidic gases such as $CO_2$, $H_2S$ and COS. A portion of the dilute slurry of solids and water is recycled to the wet scrubber 89 via line 101. Another portion of the dilute slurry is passed via line 103 to stripping zone 105 in which the slurry is contained with a stripping gas introduced into the stripping zone through line 107 to remove at least a portion of the acidic gases from the water-solids slurry. Typically, the stripping gas is steam. The vaporous effluent of the stripping zone, which comprises the strip acid gases, is removed from the stripping zone through line 109 and passed into line 95 for introduction into the gas clean-up unit. Alternatively, the vaporous effluent of the stripping zone may be passed into line 87 for introduction into the wet scrubber. The stripped water-solid slurry is removed from stripper 105 by line 111.

Having thus broadly described the present invention and a preferred and most preferred embodiment thereof, it is believed that the same will become even more apparent by reference to the following examples. It will be appreciated, however, that the examples are presented solely for purposes of illustration and should not be construed as limiting the invention.

EXAMPLE 1

In this example, 1 gram of a coal liquefaction bottoms derived from an Illinois coal were charged to a bench scale batch coking unit. $N_2$ was passed through the coker and used at a rate of 40 cc/min. to purge the vaporous products overhead. The coking was accomplished at a temperature of 1000° F. and the coking charge was held at this condition for about 15 minutes. The coking run was then discontinued, the products recovered, cooled and separated and the amount of liquid boiling below 1000° F. was determined to be 16.9 grams.

EXAMPLE 2

In this example, the bench scale coking run of Example 1 was repeated using a sample of the same bottoms used in Example 1, but a 50/50 mixture of gaseous ammonia and nitrogen was used to purge the vaporous products overhead at a rate of 40 cc/min. The coking run was continued for 15 minutes. After the run was completed, the products were cooled and separated and the amount of liquid product boiling below 1000° F. was determined to be 22.2 grams of liquid per 100 grams of bottoms feed.

In comparing the results of Examples 1 and 2, it will be apparent that the use of gaseous ammonia resulted in an increase of 5.3 grams of 1000- liquids as products. Moreover, the liquid products obtained with ammonia were, generally, lighter than those obtained without ammonia.

EXAMPLE 3

A bench scale coking run identical to that of Example 1 was completed except that a recycle bottoms from a coal liquefaction process containing 64 weight percent carbon was substituted for the liquefaction bottoms used in Example 1. Again, the coking was accomplished at 1000° F. using nitrogen at a rate of 40 cc/min. After the run was completed, the products were cooled and separated and 13.2 grams of liquid boiling below 1000° F. was obtained per 100 grams of bottoms feed.

EXAMPLE 4

The bench scale coking run of Example 3 was repeated except that a 50/50 mixture of ammonia and nitrogen was used. After the run was completed, the products were cooled and separated and 20.7 grams of liquid product boiling below 1000° F. was produced per 100 grams of bottoms feed.

Comparing the results of Examples 3 and 4, it can be seen that the use of ammonia resulted in an increase of 7.5 grams of liquid product per 100 grams of bottoms feed. This is, of course, more than a 50 percent increase in liquid yield. Moreover, the products obtained when ammonia was used were, generally, of lighter molecular weight and of better quality than those obtained without ammonia.

EXAMPLE 5

In this example, a bench scale coking run similar to that of Example 1 was made using a once-through bottoms from a coal liquefaction process comprising 69 weight percent carbon. The coking was accomplished at 900° F. After the run was completed, the products were cooled and separated and the yield of liquid product boiling below 1000° F. was 11.8 grams per gram of feed.

EXAMPLE 6

The run of Example 5 was repeated except that in this example, a 50/50 mixture of ammonia and nitrogen was used. After the run was completed, the products were cooled and separated and the yield of liquid product boiling below 1000° F. was 19.1 grams per 100 grams of bottom feed. The increase of 7.3 grams per 100 grams of feed in the liquid yield is more than a 60 percent increase at the conditions employed. Moreover, the liquid product was, generally, lighter boiling and of higher quality.

EXAMPLE 7

In this example, the run of Example 5 was repeated except that a recycle bottoms from a coal liquefaction operation containing 64 weight percent carbon was used as the feedstock. In this run, the yield of liquid boiling below 1000° F. was 9.0 grams per 100 grams of bottom feed.

EXAMPLE 8

In this example, the run of Example 7 was repeated except that a 50/50 mixture of gaseous ammonia and nitrogen was used to effect fluidization. The yield of liquid boiling below 1000° F. in this example was 13.1 grams of liquid per 100 grams of bottoms feed.

A comparison of the results obtained in Examples 7 and 8 show that the liquid yield increased 4.1 grams per 100 grams of bottom feed when ammonia was used during the coking of a bottoms feedstock containing 64–70 weight percent carbon. This is an increase of nearly 50 percent. Moreover, the liquid product obtained was, generally, lighter in character than that obtained without ammonia and the liquid product was of higher quality.

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for the purpose of determining the true scope of the present invention.

Having thus described and illustrated the invention, what is claimed is:

1. In a coking process wherein a normally solid carbonaceous material is coked at a temperature within the range from about 850° to about 1400° F. and at a pressure within the range from about 5 to about 150 psig and the coke fluidized during the coking operation, the improvement wherein gaseous ammonia or a gaseous ammonia precursor is added to the coker in an amount sufficient to provide from about 1 to about 60 wt % gaseous ammonia in the coker based on the weight of carbon in said solid carbonaceous material.

2. The process of claim 1 wherein sufficient gaseous ammonia or a gaseous ammonia precursor is added to provide from about 2 to about 15 weight percent gaseous ammonia in the coker based on the weight of carbon in the solid carbonaceous material.

3. The process of claim 2 wherein said solid carbonaceous material is a carbonaceous residue from a coal liquefaction operation.

4. In an integrated coking and gasification process wherein a normally solid carbonaceous material is coked at a temperature within the range from about 850° to about 1400° F. and at a pressure within the range from about 5 to about 150 psig and at least a portion of the coke gasified in a gasifier and wherein the coking is accomplished is a fluid bed, the improvement wherein gaseous ammonia or a gaseous ammonia precursor is added to the coker in an amount sufficient to provide from about 1 to about 60 wt % gaseous ammonia in the coker based on the weight of carbon in said solid carbonaceous material.

5. The process of claim 4 wherein gaseous ammonia or a gaseous ammonia precursor is added in an amount sufficient to provide from about 2 to about 15 weight percent gaseous ammonia in the coker based on the weight of carbon in said solid carbonaceous material.

6. The process of claim 5 wherein the normally solid carbonaceous material is a normally solid residue from a coal liquefaction operation.

7. The process of claim 1 wherein said normally solid carbonaceous material is coked at a temperature within the range from about 900° to about 1200° F. and at a pressure within the range from about 5 to about 45 psig.

8. The process of claim 4 wherein said normally solid carbonaceous material is coked at a temperature within the range from about 900° to about 1200° F. and at a pressure within the range from about 5 to about 45 psig.

* * * * *